US005650792A

United States Patent [19]

Moore et al.

[11] Patent Number: 5,650,792

[45] Date of Patent: Jul. 22, 1997

[54] COMBINATION GPS AND VHF ANTENNA

[75] Inventors: Shaun G. Moore, Shirley; Vincent A. Marotti, Sayville; Kenneth Plate, Bohemia, all of N.Y.

[73] Assignee: Dorne & Margolin, Inc., Bohemia, N.Y.

[21] Appl. No.: 308,450

[22] Filed: Sep. 19, 1994

[51] Int. Cl.[6] ..... H01Q 21/00; H01Q 1/36

[52] U.S. Cl. ..... 343/725; 343/729; 343/895

[58] Field of Search ..... 343/725, 726, 343/728, 729, 895, 850, 852, 853, 855, 858, 859, 865, 866; H01Q 21/00, 1/36

[56] References Cited

U.S. PATENT DOCUMENTS

| | | | |
|---|---|---|---|
| 1,889,568 | 11/1932 | Pickard | 343/728 |
| 2,913,722 | 11/1959 | Brueckmann | 343/724 |
| 2,948,894 | 8/1960 | Carpenter, Jr. | 343/895 |
| 3,465,344 | 9/1969 | Scott et al. | 343/852 |
| 3,739,390 | 6/1973 | Poppe, Jr. et al. | 343/729 |
| 3,950,757 | 4/1976 | Blass | 343/791 |
| 4,030,100 | 6/1977 | Perotti | 343/709 |
| 4,329,690 | 5/1982 | Parker | 343/709 |
| 4,879,563 | 11/1989 | Takeda et al. | 343/725 |
| 5,072,232 | 12/1991 | Korner | 343/729 |
| 5,457,469 | 10/1995 | Diamond et al. | 343/895 |

*Primary Examiner*—Hoanganh T. Le

[57] ABSTRACT

A combination antenna for aircraft application is disclosed. The antenna has a shell similar to that of a conventional VHF communication antenna, but it houses a monopole VHF and a volute GPS antennas. Provisions are made to enable the GPS antenna to be situated beneath the VHF antenna, but yet have full view of the upper hemisphere and avoid interference even though no structural shielding is provided. The combination antenna is mountable on the pre-existing base used for the conventional single VHF communication antenna and is operable with the pre-existing cable used to transmit the signal of the replaced single VHF communication antenna.

26 Claims, 3 Drawing Sheets

COMBINATION GPS AND VHF ANTENNA

BACKGROUND OF THE INVENTION

1. Field of the Invention

The present invention relates to a combination antenna and, more particularly, to a combination antenna having a Global Positioning System antenna (GPS) and a VHF communication antenna co-located within a common structure and operable simultaneously.

2. Description of the Related Art

Conventionally, antennas are designed to service a single operating band, utilizing a single operating mode. Thus, multiplicity of systems operable at different bands necessarily leads to the profusion of antennas on the host platform. Because each system has both installation and maintenance costs associated with it, it is desirable, whenever possible, to combine and integrate the various system components.

A carefully designed integration is particularly beneficial when a new system is added to an already operating platform. In such cases, the platform needs to be removed from service and, generally, the cost of adding the new system are governed by the off-service time. Moreover, the addition of a new antenna necessitates careful designing to prevent interference with the existing antennas. Thus, one must carefully select the location on the platform for the installation of the appropriate antennas, and provide for effective shielding where necessary. One must also take into account compliance with appropriate government safety rules and other certification requirements when applicable, such as an FAA airworthiness certification.

One way to integrate the various systems is to combine several antennas into a single structure. Such a combination is disclosed, for example, in U.S. Pat. Nos. 4,030,100 and 4,329,690. Both of these patents relate to marine vessel applications that include a GPS antenna in combination with other antennas. In order to provide a clear view of the top hemisphere, these references teach positioning the GPS antenna at the top of the arrangement, so as to be unobstructed by the other antennas. Similarly, in order to prevent interference, elaborate structural shielding is described.

Since aerodynamic, weight, and space considerations are of utmost importance in aircraft applications, the requirements of having the GPS antenna physically shielded and positioned on top of the structure is of major disadvantage. The GPS antenna is of considerable thickness, and aerodynamic considerations would, therefore, require it to be mountable as close as possible to the aircraft fuselage. Similarly, the structural shielding requires additional space and adds burdensome weight. It is therefore desirable to provide for a combination antenna having the GPS antenna situated at the bottom of the structure and to dispense with the physical shielding.

SUMMARY OF THE INVENTION

Accordingly, it is an object of the present invention to provide for two antennas which are co-located on a common structure and which are operable simultaneously.

It is another object of the present invention to provide for two antennas that are co-located on a common structure having an aerodynamic design.

Yet another object of the present invention is to provide for a GPS antenna and a VHF antenna that are co-located on an aerodynamically designed common structure, and are operable simultaneously.

It is another object of the present invention to provide for a GPS antenna and a VHF antenna that are co-located on an aerodynamically designed common structure, wherein the GPS antenna is situated below the VHF antenna.

Another object of the present invention is to provide for a GPS antenna and a VHF antenna that are co-located on an aerodynamically designed common structure, wherein the GPS antenna is situated below the VHF antenna and requires no structural shielding.

It is another object of the present invention to provide for a GPS antenna and a VHF antenna that are co-located on a common structure similar to that previously used for a single VHF communication antenna, and wherein the common structure is mountable on the base previously used for mounting the single VHF communication antenna.

It is yet another object of the present invention to provide for a GPS antenna and a VHF antenna that are co-located on a common structure similar to that previously used for a single VHF communication antenna, and wherein the common structure is mountable on the base previously used for mounting the single VHF communication antenna and the signal of both antennas are transmitted via a single cable previously used for the single VHF communication antenna.

To achieve these and other advantages and objectives, the present invention provides a design whereby a volute GPS antenna and a monopole VHF whip antenna are housed in a common structure similar to that previously used on aircraft for conventional VHF communication antenna. The GPS antenna is located under the VHF antenna, thereby allowing for better aerodynamics. The two antennas share a common feed structure and transmit signals over the pre-existing single cable that was previously used for the single VHF communication antenna. Electrical isolation is provided to allow for simultaneous operation, while dispensing with the need for structural shielding.

BRIEF DESCRIPTION OF THE DRAWINGS

Other objects and advantages of the present invention will become apparent from the following description of the preferred embodiment with reference to the drawing, in which.

DETAILED DESCRIPTION OF THE PREFERRED EMBODIMENT

As the number of commercial flights increases, technology is challenged to provide for innovative systems to increase the safety and manageability of air traffic. One such system is the Global Positioning System (GPS). However, in order to achieve the most benefit of the system, each airplane must be equipped with receiving equipment, including a GPS antenna.

There are many problems involved in retro-fitting an in-service aircraft with a GPS antenna. First, the time that the aircraft has to be in the shop and out of service for retro-fitting is very costly for the operator. Therefore, any system which requires elaborate shop procedure for installation is prohibitively expensive. Second, the GPS antenna must have an aerodynamic profile and be of as light a weight as possible. Third, while the antenna must have an unobstructed view of the upper hemisphere, it must also be protected from interferences and coupling. Finally, the entire system must be certifiable by the FAA.

In order to reduce shop time, it is desirable to be able to install the GPS antenna on an already existing mount. The combination antenna of the present invention is designed to be installed on an existing VHF communication antenna mount, such as, for example, the DM C70-1/A, marketed by Dorne & Margolin, Inc. Once the new antenna is installed, it is also desirable to provide for system integration so that the aircraft headliner will not have to be removed for wiring the new antenna. For that purpose, the combination antenna of the present invention uses the pre-existing VHF communication cable connected to a diplexer to service both the new GPS and the reinstalled VHF communication antennas. Thus, in order to install the antenna of the present invention, one has to merely remove the old VHF communication antenna, mount the new combination antenna using the mounting holes of the old VHF communication antenna, and connect the instrument side of the existing feed cable to the diplexer of the present invention to thereby have VHF and GPS outlets.

Figure 1:
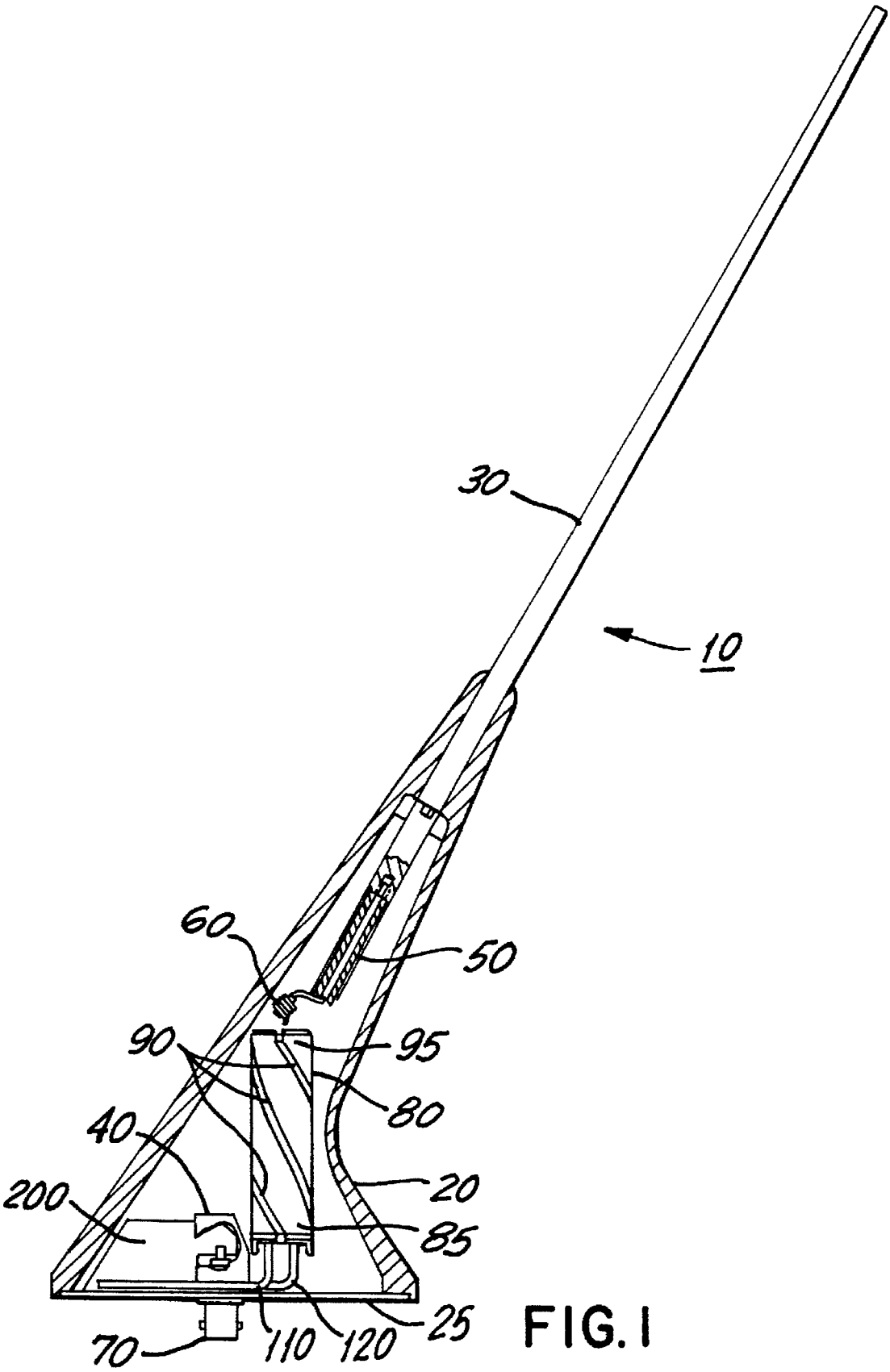
FIG. 1 is a sectional view of the assembly which comprises the antenna of the present invention.

The general structure of the combination antenna 10 of the present invention is shown in FIG. 1. The base 20 is of similar construction and shape as that of a conventional VHF communication antenna (e.g. the Dorne & Margolin antenna mentioned above). Mount 25 is also of similar construction and shape as that of a conventional VHF communication antenna, and constructed so as to be mountable on an existing conventional VHF communication antenna base and be connected via single coaxial connector 70 to the existing feed cable (not shown). The VHF communication antenna 30 is of similar construction as the conventional antenna, except that a choke 50, which will be described later, is constructed in its receiving end. As can be readily seen, the structure described so far is similar to a conventional VHF communication antenna and, if connected properly, can be easily installed and function as a conventional VHF communication antenna.

The GPS antenna 80 is a volute antenna having a non-conductive cylindrical core 83. Four conductive spiral arms 90 are affixed to the core 83 lengthwise. As the spiral arms 90 span the length of core 83, they rotate one half of a revolution counterclockwise when viewed downwards from the feed end 95. In FIG. 1, coaxial cables 110 and 120 are shown to emanate from the diplexer circuit 200 and enter the GPS antenna 80 through the inlet side 85. Their respective connections to the GPS antenna 80, the series/resonant shunt tuning circuit 60, and the VHF communication antenna 30 will be explained later with reference to FIG. 2. The diplexer circuit 200 is protected by shield 40, thereby preventing feedback to the GPS antenna 80.

Figure 2:
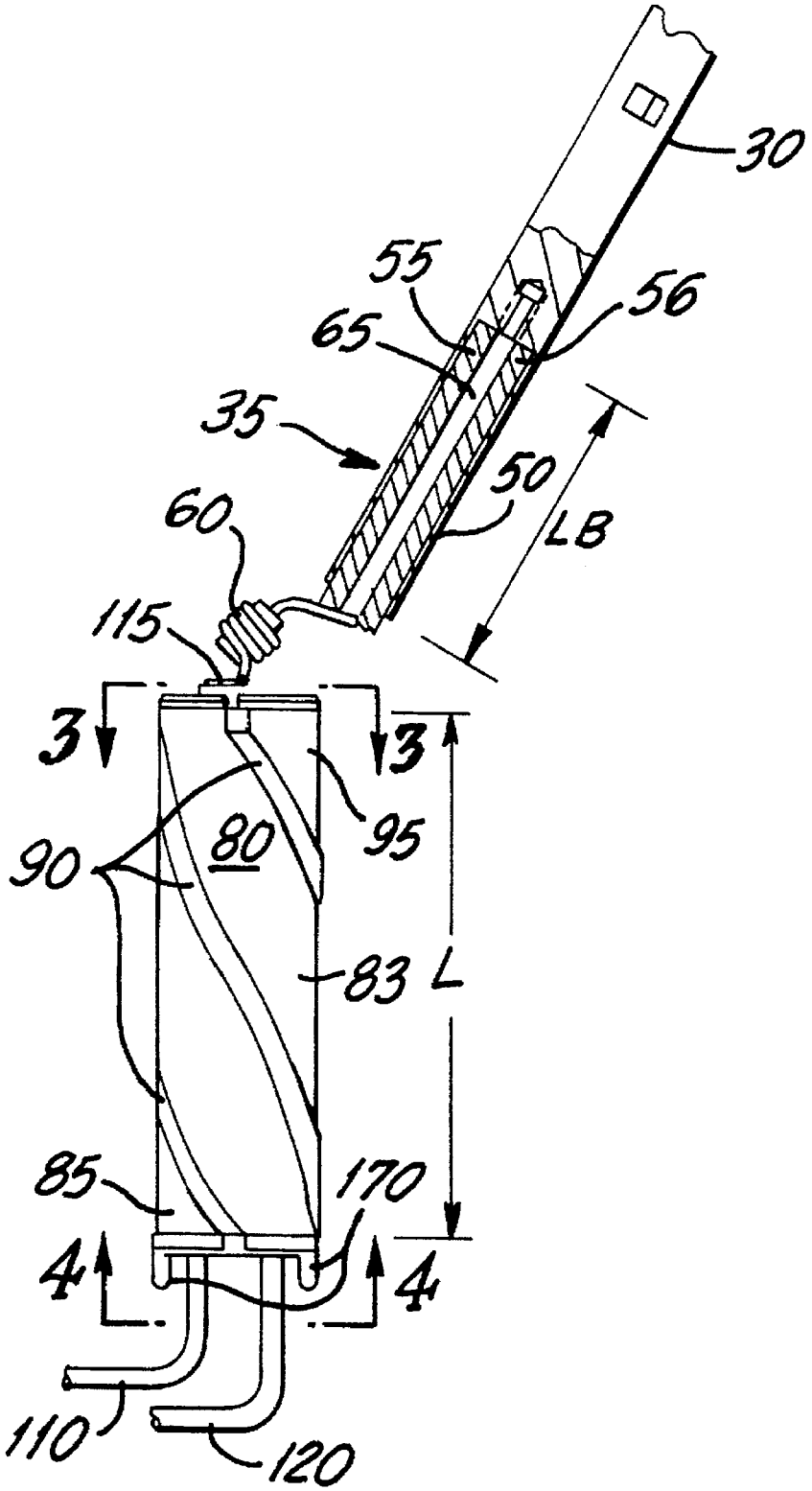
FIG. 2 is a detailed view of the volute and monopole feed assembly according to the present invention.
Figure 3:
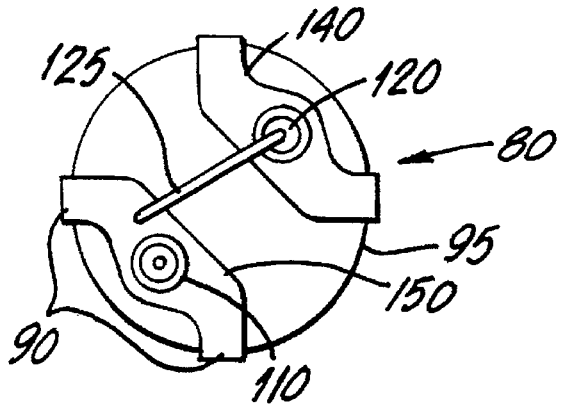
FIG. 3 is a sectional view through lines 3—3 of FIG. 2, showing the connections at the feed end of the GPS antenna.
Figure 4:
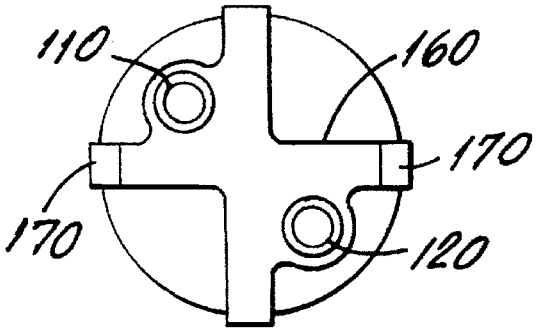
FIG. 4 is a sectional view through lines 4—4 of FIG. 2, showing the connections at the inlet side of the GPS antenna.

Further details of the combination antenna 10 of the present invention can be seen in FIGS. 2–4. The axial length L of the GPS antenna 80 is approximately one third of a wavelength, and the length/diameter ratio is designed to provide a cardioid-shape reception coverage. As shown in FIG. 3, a pair of the spiral arms 90 are connected at feed end 95 by bridge 150, and the other pair is connected via bridge 140. Both pairs of spiral arms 90 are connected at inlet side 85 by bridge 160, as shown in FIG. 4. In each of the pairs of the spiral arms 90, the spiral arm that is located further counterclockwise when viewed from the feed end 95 includes an extension 170 of approximately one-sixteenth of a wavelength, extending downwardly from the inlet side 85. (FIGS. 2 and 4). The extension 170 causes a shift in impedance between the two spiral arms 90 of each pair, thereby inducing a ninety degrees phase shift therebetween. Since the phase shift occurs at both pairs of spiral arms 90, a quadrature feed of 0°, −90°, −180°, and −270° is achieved. This arrangement produces a semihemispherical radiation pattern that is right hand circularly polarized, suitable for GPS signal reception. However, it is understood that the spiral arms 90 can be rotated clockwise and the extension 170 can be reversed if left hand circular polarization reception is desired.

Coaxial cables 110 and 120 are configured to form a quarter wave balun in a manner which will be explained with reference to FIGS. 2, 3, and 4. Coaxial cables 110 and 120 enter the GPS antenna 80 from inlet side 85, passes through the field-neutral core 83 of the GPS antenna 80, and are open circuited at the feed end 95 by connecting the conductive sleeve of coaxial cable 110 to bridge 150 and the conductive sleeve of coaxial cable 120 to bridge 140. The conductive sleeves are short-circuited at the inlet side 85 by connecting their respective conductive sleeves to bridge 160. The center conductor 125 of coaxial cable 120 is connected to bridge 150, thereby creating a 180° phase shift between the bridges 150 and 140, and balancing the feed to the GPS antenna 80.

While the conductive sleeve of coaxial cable 110 is used to form the balun for the GPS antenna 80, the center conductor 115 (FIG. 2) of coaxial cable 110 serves as the feed for the VHF communication antenna 30. As seen in FIG. 2, the center conductor 115 extends beyond feed end 95 and is connected to the series/resonant shunt circuit 60. The series/resonant shunt tuning circuit 60 is used to tune the monopole VHF antenna with reference to the plane that is parallel to, and includes the bridges 140 and 150.

Since the center conductor 125 of coaxial cable 120 and the spiral arm 90 are connected to the conductive sleeve of coaxial cable 110, the GPS antenna 80 is at the same electrical potential as the conductive sleeve of the coaxial cable 110 which feeds the VHF antenna 30. Thus, having the center conductor 115 of coaxial cable 110 extended above the reference plane, the GPS antenna serves as a ground sleeve for the VHF communication antenna 30.

Choke 50 is provided in order to maintain isolation between the two operating modes of the combination antenna 10 of the present invention. Choke 50 is constructed by boring a cavity 55 in the feed end 35 of VHF antenna 30. The cavity 55 is filled with a dielectric material 56, such as polytetrafluorethylene sold under the trademark Teflon™, and a conductor 65 is centered therein to transmit signals between the VHF antenna 30 and series/resonant shunt circuit 60.

The electrical length LB of the cavity 55 is approximately one-fourth the wavelength, so that it will resonate as an open circuit at the center of the operating band of the GPS antenna 80. The axial length L of the GPS antenna is related to the length LB of the cavity 55 of the choke 50 so as to prevent currents at the VHF frequency. This prevents the GPS from interfering with the VHF communication antenna. That is, at the VHF frequency, the axial length L is chosen so that the GPS antenna will appear as a short circuit, thereby inhibiting current generation and isolating the GPS antenna from the VHF communication antenna.

As shown in FIG. 1, coaxial cables 110 and 120 are connected to the diplexer circuit 200. The diplexer circuit 200 is connected to a single coaxial connector 70, which is of the same type as the connector of the conventional VHF communication antenna. The diplexer circuit 200 is designed to combine the GPS and the VHF communication signals into one signal to be transmitted over the pre-existing VHF communication cable.

Figure 5:
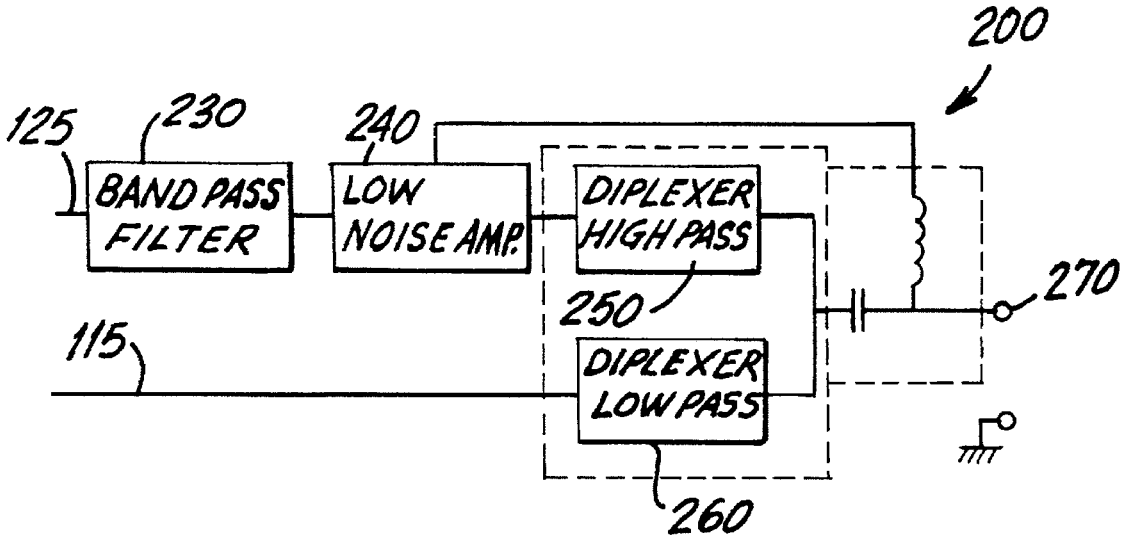
FIG. 5 is a block diagram of the diplexer of the present invention.

A block diagram of the diplexer circuit 200 is shown in FIG. 5. The center conductor 125 of coaxial cable 120, which is used to feed the GPS antenna 80, is connected to a band pass filter 230. The band pass filter transmits the signals received from the GPS antenna to the low noise amplifier 240, and rejects all other signals. The low noise amplifier 240 amplifies the GPS signal and transmits it to the diplexer high pass side 250. The diplexer high pass side 250 ensures that VHF communication signal does not enter the GPS side.

The center conductor 115 of coaxial cable 110, which is use to feed the VHF antenna 30, is connected to the diplexer low pass side 260. The diplexer high pass side 250 and low pass side 260 are connected to the single coaxial connector 70 at point 270. Thus, the pre-existing VHF communication cable is used to transmit the high frequency GPS and low frequency VHF signals, and a DC power for the low noise amplifier 240. A similar diplexer is used on the other side of the pre-existing VHF communication cable in order to separate the signals to their respective instruments.

As described in details above, the combination antenna 30 of the present invention is advantageous in that it allows for the GPS antenna to be located below the VHF communication antenna, thereby allowing for an aerodynamic design; it allows for simple, fast, and easy replacement of a conventional VHF antenna for a VHF/GPS combination antenna which is operable with the pre-existing VHF coaxial feed; and it provides for control over the shielding and coupling of the two antennas, and other parameters involved in FAA certification.

Although the invention has been described and shown in terms of a preferred embodiment thereof, it will be understood by those skilled in the art that changes in form and detail may be made therein without departing from the spirit and scope of the invention as defined in the appended claims.

What is claimed is:

1. A multiple antenna system comprising:

a mounting structure;

a monopole antenna mounted on said mounting structure at a first level;

a three-dimensional volute antenna mounted on said mounting structure at a second level lower than said first level of said monopole antenna, said three-dimensional volute antenna including a plurality of electrically-conductive spiral arms configured for reception of a circularly polarized signal;

wherein said monopole and three-dimensional volute antennas are operable simultaneously.

2. The multiple antenna system of claim 1, wherein the three-dimensional volute antenna comprises a circularly polarized radiator capable of an unobstructed hemispherical reception.

3. The multiple antenna system of claim 2, wherein the monopole antenna comprises a linearly polarized radiator capable of omni-directional reception in the azimuthal plane.

4. The multiple antenna system of claim 3, wherein said three-dimensional volute antenna is connected to a balanced line.

5. The multiple antenna of claim 1, wherein said plurality of electrically-conductive spiral arms define an inner neutral space and wherein a feed of said monopole antenna passes through said inner neutral space.

6. A multiple antenna system comprising:

a mounting structure;

a monopole antenna mounted on said mounting structure at a first level;

a three-dimensional volute antenna mounted on said mounting structure at a second level lower than said first level of said monopole antenna;

wherein said monopole and three-dimensional volute antennas are operable simultaneously; and wherein said three-dimensional volute antenna further comprises two pairs of radiating elements, and whereby one radiating element of each of said pairs of radiating elements has higher impedance than the other radiating element of the same said pair of radiating elements, thereby realizing a ninety degrees phase shift between the two radiating elements of each of said pair of radiating elements.

7. The multiple antenna system of claim 6, wherein said three-dimensional volute antenna is tuned for Global Positioning System reception and said monopole antenna is tuned to VHF communication frequency.

8. The multiple antenna of claim 6, wherein said two pairs of radiating elements define an inner neutral space and wherein a feed of said monopole antenna passes through said inner neutral space.

9. The multiple antenna of claim 6, further comprising resonant shunt circuit interconnected between said monopole antenna and said three-dimensional volute antenna.

10. A multiple antenna system comprising:

a mounting structure;

a monopole antenna mounted on said mounting structure at a first level;

a three-dimensional volute antenna mounted on said mounting structure at a second level lower than said first level of said monopole antenna;

a diplexer circuit;

connecting means to connect said diplexer circuit to said monopole and three-dimensional volute antennas;

a single output-input connector connected to said diplexer circuit and configured to transmit the signals of said monopole and three-dimensional volute antennas into a single communication cable; and, wherein said monopole antenna and said three-dimensional volute antenna are operable simultaneously.

11. The multiple antenna system of claim 10, wherein said connecting means comprises a first and a second coaxial cable connected to said diplexer circuit and configured to define a balanced feed for said three-dimensional volute antenna and an unbalanced feed for said monopole antenna.

12. The multiple antenna system of claim 11, wherein each of said first and second coaxial cables comprises a center conductor and a sleeve conductor and wherein said connecting means further comprises a resonant shunt circuit interconnected between said monopole antenna and a center conductor of said first coaxial cable, and wherein the sleeve conductors of said first and second coaxial cables are connected to said three-dimensional volute antenna and a center conductor of said second coaxial cable is connected to said sleeve conductor of said first coaxial cable at a location where said sleeve conductor of said first coaxial cable is connected to said three-dimensional volute antenna.

13. The multiple antenna system of claim 12, wherein said monopole antenna is tuned to VHF communication frequency and said three-dimensional volute antenna is tuned to Global Positioning System frequency.

14. The multiple antenna system of claim 13, wherein said monopole antenna further comprises a choke configured to resonate at said Global Positioning System frequency.

15. The multiple antenna system of claim 12, wherein said monopole antenna further comprises a choke configured to resonate at a frequency of said volute antenna.

16. The multiple antenna of claim 10, wherein said three-dimensional volute antenna defines an inner neutral space and wherein said connecting means passes through said inner neutral space.

17. A multiple antenna system comprising:

a mounting structure;

a monopole antenna mounted on said mounting structure at a first level;

a cylindrical volute antenna mounted on said mounting structure at a second level lower than the first level of said monopole antenna, said cylindrical volute antenna having a cylindrical core portion and two pairs of spiral radiating elements rotating one half a revolution while spanning the length of said volute antenna;

a diplexer circuit;

connecting means to connect said diplexer circuit to said monopole and cylindrical volute antennas;

a single output-input connector connected to said diplexer circuit and configured to transmit the signals of said monopole and cylindrical volute antennas into a single communication cable; and, wherein said monopole and cylindrical volute antennas are operable simultaneously, and said cylindrical volute antenna is capable of an unobstructed hemispherical reception.

18. The multiple antenna system of claim 17, wherein said volute antenna is tuned to Global Positioning System frequency and said monopole antenna is tuned to VHF communication frequency.

19. The multiple antenna system of claim 18 wherein said volute antenna is configured to provide a ground sleeve for said VHF communication antenna.

20. The multiple antenna system of claim 17, wherein said connecting means comprises:

a first and a second coaxial cables, each of which having a center conductor and a sleeve conductor;

a resonant shunt circuit interconnected between said monopole antenna and a center conductor of said first coaxial cable; and, wherein the sleeve conductors of said first and second coaxial cables are connected to said volute antenna and a center conductor of said second coaxial cable is connected to said sleeve conductor of said first coaxial cable at a location where said sleeve conductor of said first coaxial cable is connected to said volute antenna.

21. The multiple antenna system of claim 20, wherein said monopole antenna comprises a chock configured to resonate at a frequency of said volute antenna.

22. The multiple antenna of claim 17, wherein said cylindrical core portion of said volute antenna defines an inner neutral space and wherein a feed of said monopole and volute antennas passes through said inner neutral space.

23. A multiple antenna system comprising:

a mounting structure;

a monopole antenna mounted on said mounting structure at a first level;

a circularly polarized three dimensional antenna mounted on said mounting structure at a second level lower than said first level of said monopole antenna; and choking means interposed between said monopole antenna and said circularly polarized antenna for enabling simultaneous reception of linearly polarized signals by said monopole antenna and circularly polarized signals by said circularly polarized antenna.

24. The multiple antenna system of claim 23, wherein said choking means defines a ground plane of said monopole antenna.

25. The multiple antenna system of claim 23, wherein said choking means comprises a resonant shunt circuit interconnected between said monopole antenna and said circularly polarized antenna.

26. The multiple antenna system of claim 23, wherein said monopole antenna further comprises a choke configured to resonate at a frequency of said circularly polarized antenna.

* * * * *

UNITED STATES PATENT AND TRADEMARK OFFICE

CERTIFICATE OF CORRECTION

PATENT NO. : 5,650,792

DATED : July 22, 1997

INVENTOR(S) : Shaun G. Moore, Vincent A. Marotti and Kenneth Plate

It is certified that error appears in the above-identified patent and that said Letters Patent is hereby corrected as shown below:

In the claims, claim 21, line 14 delete "chock" and substitute--choke-- therefor.

Signed and Sealed this

Twenty-third Day of September, 1997

*Attest:*

Bruce Lehman

BRUCE LEHMAN

*Attesting Officer*

*Commissioner of Patents and Trademarks*